United States Patent [19]

Kaufman et al.

[11] Patent Number: 4,585,053

[45] Date of Patent: Apr. 29, 1986

[54] HEAT EXCHANGER FOR REACTOR CORE AND THE LIKE

[75] Inventors: Jay S. Kaufman; John A. Kissinger, both of Del Mar, Calif.

[73] Assignee: The United States of America as represented by the United States Department of Energy, Washington, D.C.

[21] Appl. No.: 414,440

[22] Filed: Sep. 2, 1982

[51] Int. Cl.[4] ..... F28D 7/12; F28F 9/22

[52] U.S. Cl. ..... 165/74; 165/142; 165/158; 165/160

[58] Field of Search ..... 165/142, 74, 134 R, 165/160, 161, 158

[56] References Cited

U.S. PATENT DOCUMENTS

| | | | |
|---|---|---|---|
| 2,261,293 | 11/1941 | Samans | 165/142 X |
| 3,768,554 | 10/1973 | Stahl | 165/134 R |
| 3,833,058 | 9/1974 | Gulich | 165/161 |
| 3,850,231 | 11/1974 | Creek | 165/158 X |
| 3,857,442 | 12/1974 | Sturiale et al. | 165/134 R |
| 3,907,029 | 9/1975 | Klein et al. | 165/161 |
| 4,224,983 | 9/1980 | Thurston et al. | 165/158 |
| 4,418,748 | 12/1983 | Pouderoux et al. | 165/161 X |
| 4,431,049 | 2/1984 | Zamma et al. | 165/142 |

*Primary Examiner*—Sheldon J. Richter

*Attorney, Agent, or Firm*—Fitch, Even, Tabin & Flannery

[57] ABSTRACT

A compact bayonet tube type heat exchanger which finds particular application as an auxiliary heat exchanger for transfer of heat from a reactor gas coolant to a secondary fluid medium. The heat exchanger is supported within a vertical cavity in a reactor vessel intersected by a reactor coolant passage at its upper end and having a reactor coolant return duct spaced below the inlet passage. The heat exchanger includes a plurality of relatively short length bayonet type heat exchange tube assemblies adapted to pass a secondary fluid medium therethrough and supported by primary and secondary tube sheets which are releasibly supported in a manner to facilitate removal and inspection of the bayonet tube assemblies from an access area below the heat exchanger. Inner and outer shrouds extend circumferentially of the tube assemblies and cause the reactor coolant to flow downwardly internally of the shrouds over the tube bundle and exit through the lower end of the inner shroud for passage to the return duct in the reactor vessel.

3 Claims, 7 Drawing Figures

5
52a
52a
90
5
74b
86
96
70
12
4
4
76
78
82
70a
22
22
30
28
48
34
34
32
32
38
38
52
46
48a
44
44a
40
42
54
36
56
60
58

70
90
70c
92
90a
52a
52a

HEAT EXCHANGER FOR REACTOR CORE AND THE LIKE

BACKGROUND OF THE INVENTION

The government has rights in this invention pursuant to Contract No. DE-ATO3-76SF70046 awarded by the United States Department of Energy.

The present invention relates generally to heat exchange apparatus for transferring heat from a reactor core gas coolant to a secondary fluid medium, and more particularly to a novel compact heat exchanger which employs a plurality of bayonet type tube assemblies mounted in a manner facilitating improved installation, removal, inspection and servicing of the heat exchanger and providing improved reactor coolant flow.

In the operation of a nuclear reactor, it is a conventional practice during refueling of the reactor core to maintain the reactor core coolant, such as helium or carbon dioxide gas, at a reduced temperature by means of one or more associated steam generators, and to employ an auxiliary heat exchanger to maintain the reactor coolant at a reduced temperature during periods of emergency or when repairing one or more steam generators which generally serve this purpose. During emergency conditions, the reactor core coolant is circulated through the auxiliary heat exchanger which transfers heat from the reactor coolant to a secondary medium, generally water, circulated through a plurality of heat transfer tubes over which the primary core coolant is passed.

Prior auxiliary heat exchangers have employed relatively long straight generally vertical tubes through which the secondary fluid is passed, with the tubes being supported at their upper and lower ends by transverse tube sheets. These long tubes present assembly and operational problems due to longitudinal thermal expansion, as well as requiring intermediate tube supports which cause parasitic pressure drops through the tube bundle. Additionally, such intermediate tube supports, which also serve as lateral seismic load supports for the long tubes, tend to become very hot and therefore require that provision be made to prevent transfer of heat to the associated concrete reactor vessel. In addition, the relatively long straight tubes employed in prior auxiliary heat exchangers make installation and servicing difficult and inhibit in-service inspection.

Numerous attempts have been made to overcome the aforementioned problems encountered with prior auxiliary heat exchanger designs. One advance has been the employment of bayonet type heat exchange tubes wherein an outer sheath tube having a closed upper end is mounted coaxially over an inner bayonet tube and has its lower open end fixed to a first or primary tube sheet while the corresponding inner bayonet tube is supported by a secondary tube sheet. See, for example, U.S. Pat. No. 4,224,983 which discloses a heat exchange apparatus wherein a secondary fluid medium is passed upwardly through the inner bayonet tube of each tube assembly and is returned in a counterflow direction to primary coolant flow within the flow passage established between the inner bayonet tube and its associated outer sheath. While auxiliary heat exchangers such as disclosed in U.S. Pat. No. 4,224,983 have provided significant advances over prior auxiliary heat exchangers, they have not proven altogether satisfactory from the standpoint of facilitating installation, removal and reinstallation of the tube assemblies nor in providing access for in-service inspection. Additionally, the known heat exchangers employing bayonet type tube assemblies have also required intermediate lateral tube supports resulting in substantial parasitic pressure losses, and, because of their lengths, have required location within the reactor vessel such that the hot core coolant gas enters the heat exchanger at the lower end thereof with resultant need for insulation of the tube sheets.

SUMMARY OF THE INVENTION

One of the primary objects of the present invention is to provide a novel heat exchanger for a reactor core which finds particular application as an auxiliary heat exchanger for the reactor core coolant during standby emergency conditions.

A more particular object of the present invention is to provide a novel heat exchanger for transferring heat from a reactor gas coolant to a secondary fluid medium, which heat exchanger is relatively compact and provides greater reliability and ease of fabrication, installation and inspection than heretofore obtainable with known reactor core heat exchangers.

A feature of the heat exchanger in accordance with the present invention lies in the provision of relatively short bayonet type tube assemblies which are mounted within a core cavity below a cross duct or core coolant inlet so as to inhibit significant circulation of the hot core coolant during standby, and which enables installation, removal and in situ inspection and servicing from beneath the heat exchanger cavity in the reactor vessel.

Another feature of the auxiliary heat exchanger in accordance with the present invention lies in the provision of a compact and highly efficient assembly of bayonet type heat transfer tubes and associated shrouds which establish a downward flow path for the reactor core coolant such that the associated tube sheets are not subjected to adverse high temperatures, thus eliminating the need for insulation for the tube sheets as has heretofore been required.

Still another feature of the auxiliary heat exchanger in accordance with the present invention lies in the establishment of a relatively stagnant annulus of moderate temperature reactor core coolant peripherally of the bayonet tube bundle so as to assist in preventing heat transfer radially to the concrete reactor vessel.

Further objects, advantages and features of the present invention, together with the organization and manner of operation thereof, will become apparent from the following detailed description of the invention when taken in conjunction with the accompanying drawings wherein like reference numerals designate like elements throughout the several views.

DETAILED DESCRIPTION OF DRAWINGS

DESCRIPTION OF PREFERED EMBODIMENT

Figure 1:
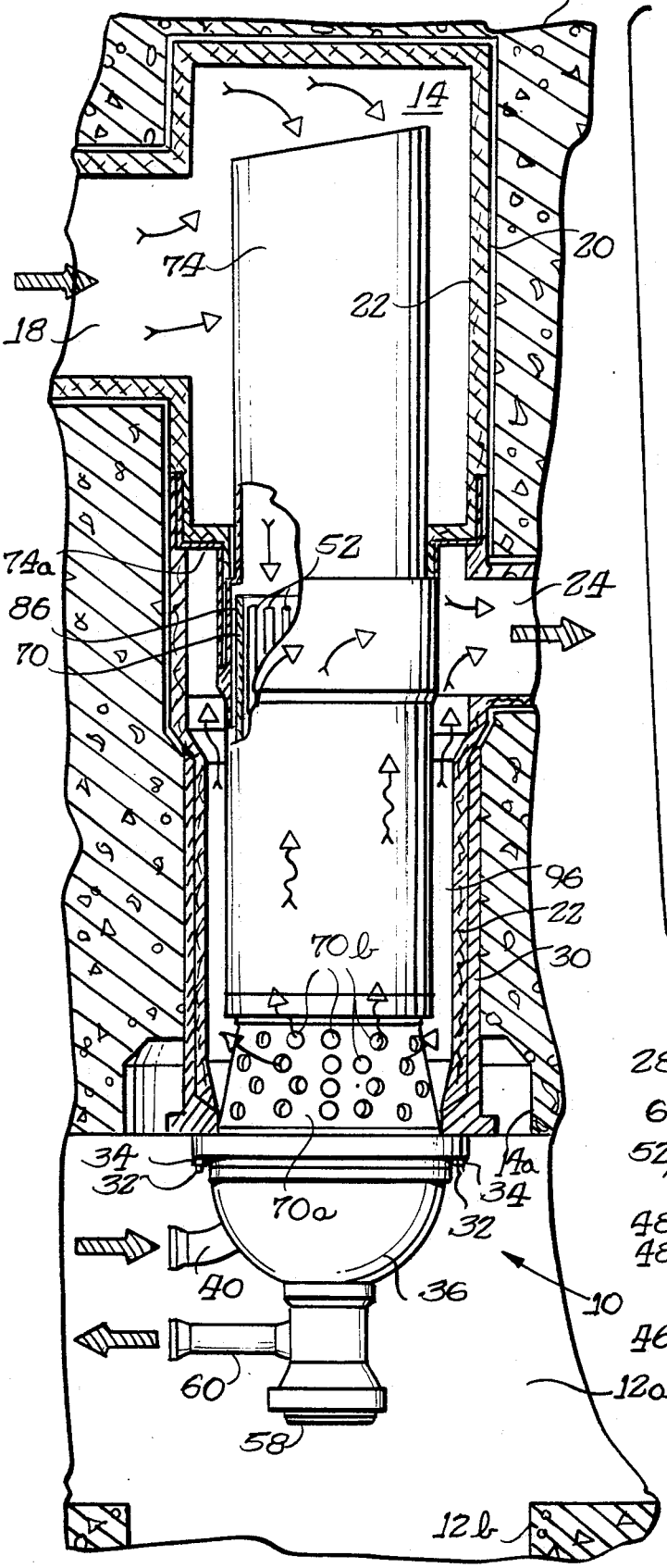
FIG. 1 is a fragmentary sectional view of a reactor core cavity in which is mounted a heat exchanger constructed in accordance with the present invention.

Referring now to the drawings, and in particular to FIG. 1, a heat exchanger in accordance with the present invention for transferring heat from a reactor gas coolant to a secondary fluid medium is indicated generally at 10. Although the heat exchanger 10 finds particular application as a core auxiliary heat exchanger in a high temperature gas cooled reactor, it will become apparent herein that the inventive concepts may be employed in other applications. In the illustrated embodiment, the heat exchanger 10 is shown as being housed within a reactor vessel, a portion of which is indicated at 12, which may comprise a prestressed concrete reactor vessel. More particularly, the heat exchanger 10 is housed within a cavity or chamber 14 defined internally of the reactor vessel 12 and opening downwardly into a lower access pit area 12*a*. As will be described, the heat exchanger 10 is of a construction which facilitates assembly, removal and in situ servicing from within the access or pit area 12*a* at the base of the reactor vessel.

Figures 2, 7:
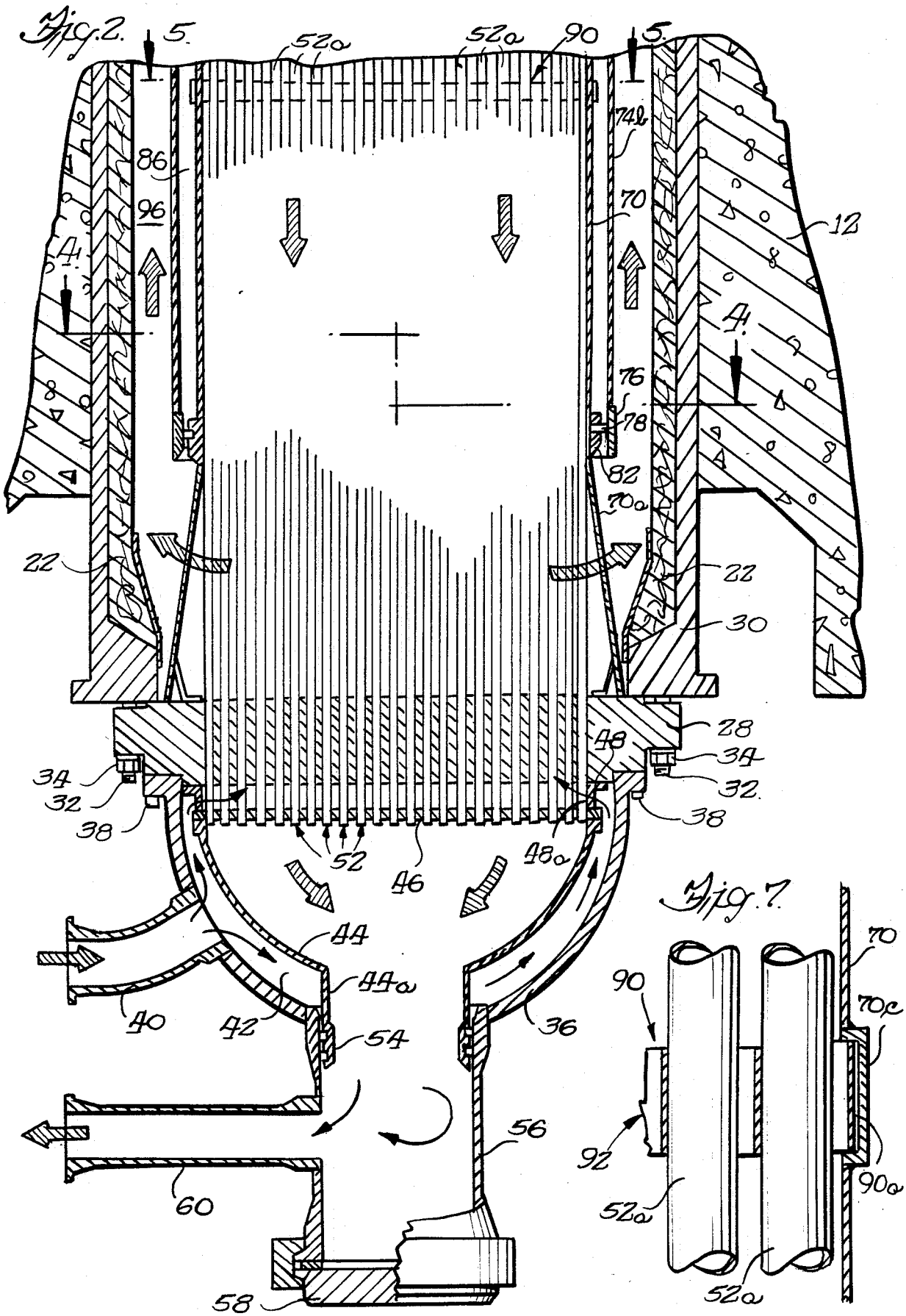
FIG. 2 is an enlarged fragmentary longitudinal sectional view of the lower portion of the heat exchanger illustrated in FIG. 1.
FIG. 7 is a fragmentary sectional view taken substantially along line 7—7 of FIG. 6.

Turning now to a more detailed description of the heat exchanger 10 in accordance with the present invention, and referring to FIG. 1 taken in conjunction with FIGS. 2 and 3, the auxiliary heat exchanger 10 is of relatively short longitudinal length and thus enables the heat exchanger cavity 14 within the reactor housing to have a substantial portion of its length located below a transverse core coolant cross duct or inlet passage 18 which conventionally communicates with the lower end of the reactor core cavity for removing core coolant gas therefrom. The auxiliary heat exchanger cavity 14 is of generally cylindrical transverse configuration and has a suitable metallic shield liner 20 establishing the outer peripheral surface of the cavity 14 and to which is suitably affixed a thermal barrier 22 in a known manner.

Because the heat exchanger 10 is of relatively short length, it is adapted to be installed and serviced from the lower end of the cavity 14 through a vertically extending entry 12*b* communicating with the access and pit area 12*a*, the height of the access area 12*a* being approximately 12 feet. While prior auxiliary heat exchangers have, because of their length, required instalation from the upper end of the reactor core, the reactor vessel 12 in the illustrated embodiment is closed above the cavity 14 and defines a lower open end 14*a* accessible from the access area 12*a*. The reactor vessel 12 has a core coolant return passage 24 formed therein which intersects the auxiliary heat exchanger cavity 14 at an elevation below the core coolant inlet passage 18 and which enables flow of core coolant from the auxiliary heat exchanger to a circulator (not shown) operative to return the reduced temperature coolant to the reactor core.

The heat exchanger 10 is supported within the cavity 14 through a primary tube sheet 28 which is releasibly mounted on the lower end of an annular metallic sleeve or housing 30 fixed upwardly within the cavity 14. Downwardly extending studs 32 are mounted on the housing 30 and are received through suitable openings in the primary tube sheet. Nuts 34 retain the primary tube sheet in releasibly fixed position to the housing 30. A semispherical housing 36 is mounted on the primary tube sheet 28 through an annular flange 36*a* and suitable mounting screws 38. The semispherical housing 36, which may be termed the primary head of the heat exchanger 10, has a suitable secondary coolant inlet fitting or conduit 40 mounted thereon adapted for connection to a source of secondary coolant fluid medium, such as water, to facilitate introduction of the secondary coolant into an annular flow area 42 established between the semispherical housing 36 and an inner generally semispherically shaped housing 44 mounted on or formed integral with a planar secondary tube sheet 46. In the illustrated embodiment, the secondary tube sheet 46 is releasibly mounted on the lower planar surface of the primary tube sheet 28 through an annular support ring 48 which may be fixed to the secondary tube sheet 46 as by welding and which is releasibly mounted on the primary tube sheet through a plurality of circumferentially spaced screws 50. The annular support ring 48 has a plurality of openings 48*a* formed in circumferentially spaced relation therearound which define flow passages through which the secondary coolant fluid entering the flow area 42 may pass for upward flow through bayonet tube assemblies 52 to be hereinafter described. To insure that the incoming secondary coolant passes to the bayonet tube assemblies, the semispherical housing 44 has an annular depending wall 44*a* to the lower end of which is affixed a suitable seal ring 54 adapted for sliding sealing relation with a tubular flow conduit or pipe 56 fixed within a suitable opening in the housing 36. The lower end of conduit 56 is closed by a suitably sealed clamp plate 58. An outlet conduit or pipe 60 is connected to the conduit 56 intermediate its length and in a generally transverse relation thereto and serves as an outlet passage for the secondary coolant from the auxiliary heat exchanger.

Figure 3:
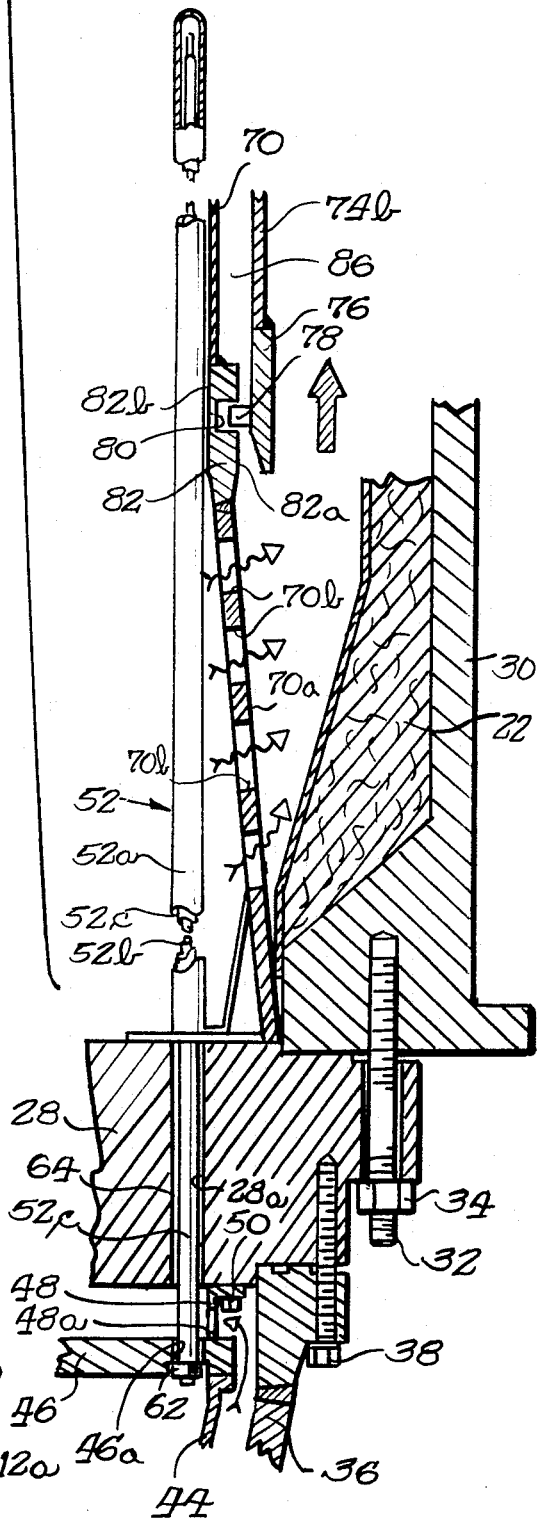
FIG. 3 is an enlarged fragmentary sectional view illustrating the manner of mounting the bayonet tube assemblies and associated shrouds.
Figure 5:
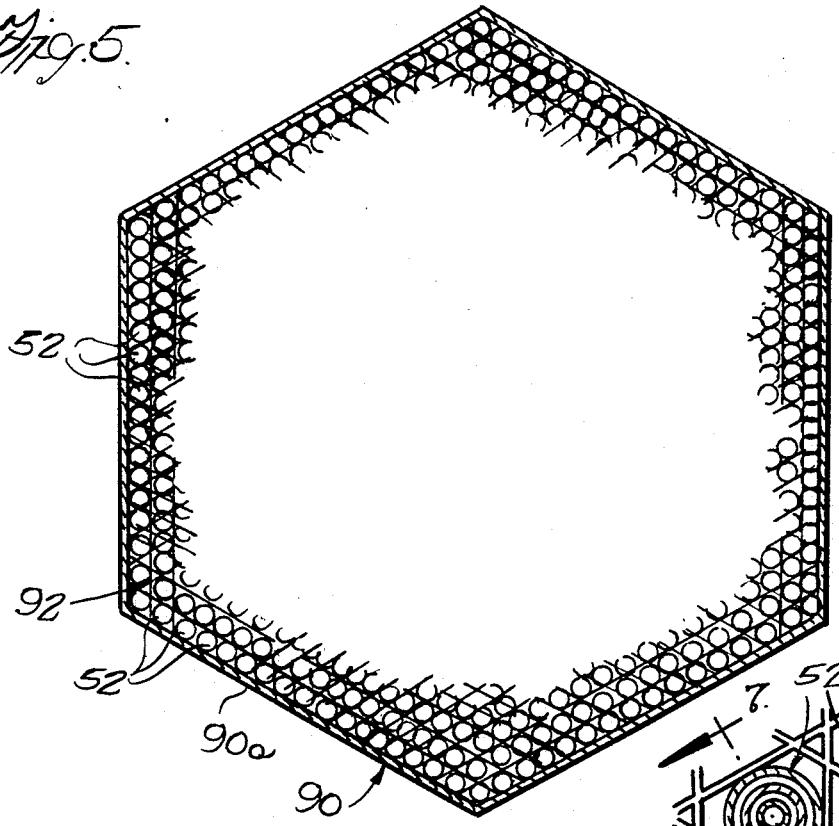
FIG. 5 is an enlarged transverse sectional view taken substantially along line 5—5 of FIG. 2.
Figure 4:
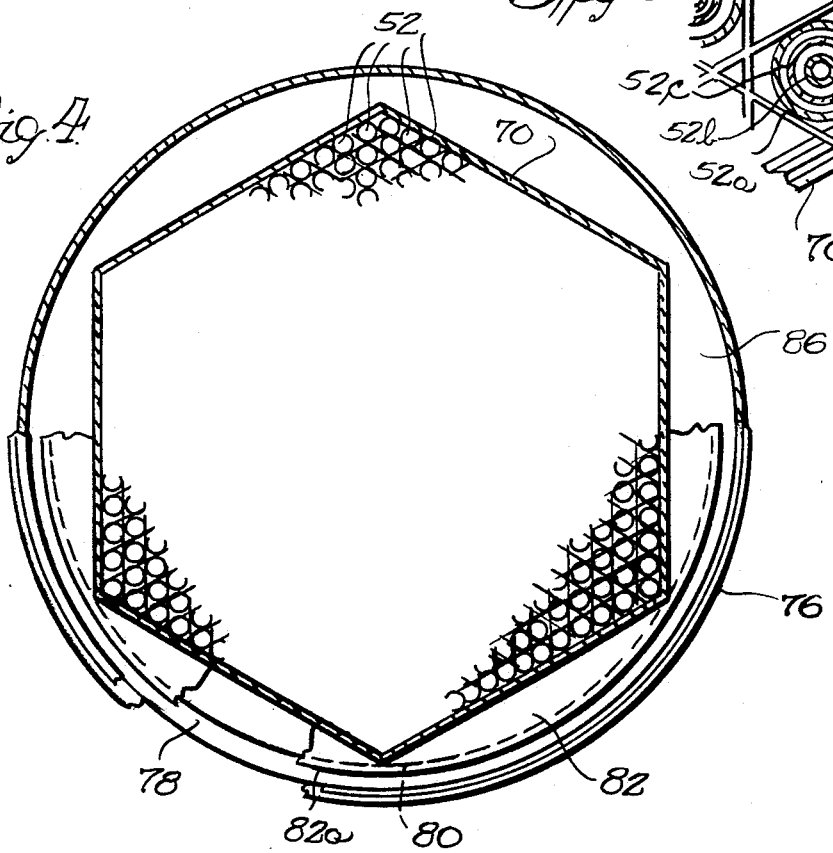
FIG. 4 is an enlarged transverse sectional view taken substantially along line 4—4 of FIG. 1, looking in the direction of the arrows.

With particular reference to FIG. 3, the primary and secondary tube sheets 28 and 46, respectively, cooperate to support a plurality of the bayonet tube assemblies 52 so that the bayonet tube assemblies extend generally vertically upwardly within the cavity 14 in substantially parallel relation with the vertical longitudinal axis thereof. The bayonet tube assemblies 52 serve as heat exchange tubes and are mounted in sufficient number on the tube sheets 28 and 46 so as to form a tube bundle comprised of a plurality of heat transfer tubes which, in the illustrated embodiment, form a hexagonal array of generally uniformly spaced heat transfer tubes as illustrated in FIGS. 4 and 5. Each of the bayonet assemblies 52 includes an outer tubular sheath 52*a*, an inner bayonet tube 52*b* and an intermediate tube 52*c*. Each outer sheath tube 52*a* has a length of approximately 16 feet and is closed at its upper end and fixed at its lower end to the upper surface of the primary tube sheet 28, as by welding.

Each inner bayonet tube 52*b* has an outer diameter spaced radially from the inner surface of the corresponding outer sheath tube and has an open upper end generally adjacent the upper closed end of the corresponding outer sheath tube. Each inner bayonet tube 52*b* extends downwardly through a corresponding bore 28*a* in the primary tube sheet 28 and also extends downwardly within a corresponding bore 46*a* in the secondary tube sheet 46. The lower end of each inner bayonet tube is supported by means of an externally threaded adapter 62 fixed on the bayonet tube and through which the inner bayonet tube extends in open communication with the area internally of housing 44 so as to enable discharge of the secondary coolant through the outlet 60.

The intermediate tube 52*c* of each tube assembly 52 is coaxial with both the corresponding outer sheath tube 52*a* and the inner bayonet tube 52*b* and extends from an upper end generally adjacent the closed end of the corresponding outer sheath downwardly through the corresponding tube sheet bores 28*a* and 46*a* such that its lower end is affixed to the corresponding adapter 62 but does not extend therethrough. Each intermediate tube 52*c* is sized so as to establish concentric annular spaces, respectively, between the intermediate tube and the corresponding outer sheath tube 52*a* and inner bayonet tube 52*b*. Each of the bores 28*a* in the primary tube sheet 28 has a diameter sufficient to establish an annular flow passage 64 between the bore and the outer surface of the corresponding intermediate tube 52*c* which is substantially equal in area to the annular flow area established between the intermediate tube and the corresponding outer sheath tube 52*a*. In this manner, secondary coolant passing through the flow passages 48*a* in the annular support ring 48 passes upwardly through the annular flow passages 64 and upwardly through the corresponding annular flow passages between the intermediate tubes 52*c* and outer sheath tubes 52*a*. When the upwardly flowing secondary coolant reaches the upper ends of the sheath tubes 52*a*, it reverses directions and passes downwardly through the inner bayonet tubes 52*b* for discharge through the outlet conduit 60. As will become more apparent hereinbelow, the upwardly flowing secondary coolant flows upwardly in counterflow relation to the hot primary core coolant passing downwardly through the auxiliary heat exchanger whereafter the heated secondary coolant is withdrawn from the heat exchanger in a continually flowing cycle. The annular area between each inner bayonet tube 52*b* and its corresponding intermediate tube 52*c* becomes filled with stagnant secondary cooling fluid and acts as a thermal barrier to improve heat transfer efficiency of the bayonet tube assemblies.

The bayonet tube assemblies 52 are maintained in generally uniformly spaced relation internally of an upstanding metallic shroud 70 which has a hexagonal transverse configuration as illustrated in FIG. 4. The shroud 70, which may be termed a first generally annular shroud, has an outwardly flared lower portion 70*a* the lower end of which is suitably affixed to and supported by the primary tube sheet 28 so as to support the upper non-flared portion of the inner shroud in substantially vertical relation. The outwardly flared lower porton 70*a* of the inner shroud has a plurality of flow passages or openings 70*b* formed therethrough to facilitate outward flow of primary coolant as will be described.

The upper end of the inner shroud 70 extends slightly above the upper ends of the heat transfer tube assemblies 52 and is received upwardly within an outer annular metallic shroud 74. The outer shroud 74 is supported generally centrally within the heat exchanger cavity 14 by an annular outwardly extending generally Z-shaped flange 74*a* which is secured to the adjacent cavity liner 20 so as to support the outer shroud both radially and longitudinally within the cavity 14. The thermal barrier 22 is formed to cover the surface of the support flange 74*a* otherwise exposed to the high temperature primary core coolant entering the duct 18.

The outer shroud 74 has an open upper end and has an enlarged diameter lower wall portion 74*b* which receives the inner shroud 70 generally coaxially upwardly therein and terminates at its lower end in an annular seal ring 76 which is formed integral with or otherwise suitably affixed to the lower end of the outer shroud wall 74*b*. The seal ring 76 has a piston ring seal 78 affixed to its inner surface in a position such that the piston ring seal is received in sliding sealing relation within an annular groove 80 formed in a seal ring guide flange 82 which forms part of the inner shroud 70 and is located between the lower end of the upper hexagonal portion of the inner shroud and its outwardly flared lower end 70*a*. The seal ring guide 82 has an outer circular surface 82*a* in which the groove 80 is formed, and has a hexogonal shaped inner surface 82*b* substantially equal in cross area to the upper hexagonal portion of the inner shroud, as illustrated in FIG. 4.

By providing the seal 78, 80 between the lower end 74*b* of the outer shroud 74 and the lower end of the upper hexagonal inner shroud 70, a dead space 86 is formed between the inner and outer shrouds which, as illustrated in FIG. 1, is in open communication with the area within the upper end of the outer shroud 74. In this manner, core coolant gas passing into the upper open end of the outer shroud 74 and passing downwardly therewithin enters the dead space 86 and creates a generally stagnant gas volume which, during operation, is at a temperature intermediate the temperature of the core coolant helium entering the auxiliary heat exchanger, generally approximately 1700°–1800° F., and the temperature of the primary coolant as it exits through the flow passages 70*b* in the inner shroud, generally approximately 600°.

Figure 6:
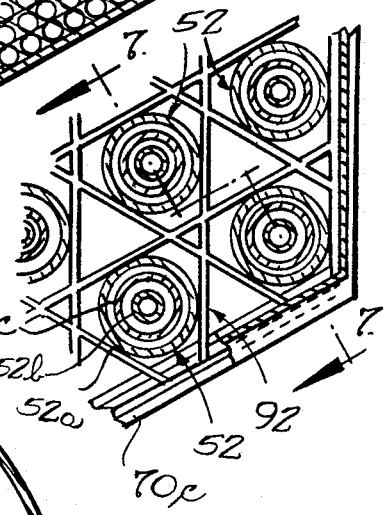
FIG. 6 is an enlarged fragmentary detail view of a portion of the tube grid assembly illustrated in FIG. 5.

Because the heat transfer tube bundle is relatively short, there is no need for a plurality of lateral seismic load restraints along the length of the tube bundle to restrain the heat transfer tubes 52 against lateral movement as have heretofore been required in heat exchangers having substantial length. In the illustrated embodiment, a single tube grid assembly 90 is mounted transversely of the heat transfer tube assemblies 52 at a position approximately two-thirds upwardly from the bottoms of the heat transfer tubes. Referring particularly to FIGS. 5, 6 and 7, taken in conjunction with FIG. 2, the tube grid assembly 90, which is shown in FIG. 5 removed from the inner shroud 70, is made from a suitable metallic material and includes an outer peripheral hexagonal shaped ring member 90*a* of substantially the same hexagonal size as the inner shroud 70. The ring 90*a* supports a gridwork, indicated generally at 92, internally thereof so as to establish discrete cells or openings through which the heat transfer tube assemblies 52 are received with the sheath tubes 52*a* engaged by the gridwork so as to maintain the heat transfer tubes in substantially fixed spaced relation. The outer hexagonal ring member 90*a* is received within a generally C-shaped rim 70*c* formed integral with or suitably secured to the hexagonal inner shroud 70 as best illustrated in FIG. 7. In this manner, the tube grid assembly 90 is maintained in substantially fixed relation along the length of the inner hexagonal shroud 70 and serves to maintain the heat transfer tubes in desired spaced relation without significantly inhibiting the flow of primary coolant gas downwardly through the shrouds 74 and 70 and through the tube bundle.

In briefly reviewing the operation of the auxiliary core heat exchanger 10, the hot core coolant gas, which may be in the temperature range of 1300°-1800° F. and at a pressure of approximately 1050 psia and flow rate of approximately 140,135 lb./hr. enters the heat exchange cavity from the inlet duct 18 and passes into the open upper end of the outer shroud 74 and downwardly through the tube bundle and outwardly through the flow openings 70*b* in the lower end of the inner shroud. The primary coolant then passes upwardly within a generally annular flow area 96 between the outer surface of the outer shroud 74 and the thermal barrier on the inner surface of the annular housing 30 and outwardly through the return passage 24 for return to the reactor core, it being understood that flow of primary coolant through the cavity 14 and auxiliary heat exchanger 10 is effected by a conventional circulator (not shown).

As the primary coolant passes downwardly within the outer and inner shrouds 74 and 70, respectively, secondary coolant, usually water, is passed into the inlet fitting 40 at an inlet temperature of approximately 165° F., pressure of approximately 1500 psia and flow rate of approximately $1.12\times10^6$ lb./hr. The secondary coolant passes upwardly through the flow passages 48*a* in the support ring 48 and through the annular flow passages 64 into the flow passages between the shield tubes 52*a* and associated intermediate tubes 52*c* in counterflow direction to the downward flow of primary core coolant. During such upward passage of the secondary coolant within the heat transfer tubes 52, the temperature of the secondary coolant is raised to approximately 545° F. by heat transfer from the downwardly flowing primary coolant the temperature of which is reduced to approximately 660° F. when it reaches the lower end of the heat transfer tubes and passes outwardly through the discharge passages 70*b*. The secondary coolant passes downwardly through the inner bayonet tubes 52*b* and is discharged from the lower ends thereof below the secondary tube sheet 46 for outward passage through the outlet pipe 60.

With the heat exchanger 10 in accordance with the present invention, the high temperature primary coolant gas is caused to move longitudinally downwardly within the heat exchanger and flow past the heat transfer tubes 52 in heat exchanger relation therewith prior to contact with the primary tube sheet 28. In this manner, the temperature of the primary coolant is substantially reduced before it impinges the primary tube sheet with the result that no additional insulation means is required for the primary tube sheet as has heretofore been necessary with prior heat exchangers employed as reactor core auxiliary heat exchangers. Additionally, because the temperature of the primary coolant is substantially reduced, i.e. to approximately 600° F., as it passes downward through the heat exchange tube bundle, a relatively low temperature primary coolant passes upwardly through the annular passage 96. As a result, thermal protection of the reactor vessel, which can safely withstand approximately 250° F., is assured without added insulation or cooling means.

By providing a relatively short heat exchanger unit, and particularly relatively short heat exchange tubes, only a single tube support grid need be provided for the heat transfer tubes. This results in substantially reduced parasitic pressure losses in the primary coolant flowing downwardly through the heat exchanger which permits a higher loss in the tube bundle. Another advantage of the short length heat exchanger is its ability to be located below the inlet or cross duct 18 for the primary core coolant. With such configuration, circulation of the high temperature primary coolant through the heat exchanger during standby is inhibited with a corresponding reduction in shroud metal temperatures and parasitic heat losses.

The relatively short length heat exchanger of the invention and its location within the reactor vessel enable assembly, installation, servicing and removal of the heat transfer tubes from beneath the heat exchanger cavity. For example, by detaching the primary head housing 36 and the inner semispherical housing 44, the inner bayonet tubes 52*b* and associated intermediate tubes 52 may be withdrawn from the secondary tube sheet 46 for individual servicing and/or replacement while simultaneously enabling in situ inspection of the associated outer sheath tubes 52*a*. Alternatively, the secondary tube sheet 46 could be lowered to simultaneously lower all of the inner bayonet tubes 52*b* and intermediate tubes 52*c*.

While a preferred embodiment of the present invention has been illustrated and described, it will be understood to those skilled in the art the changes and modifications that may be made therein without departing from the invention in its broader aspects. Various features of the invention are defined in the following claims.

What is claimed is:

1. A heat exchange arrangement for transferring heat from a reactor gas coolant to a secondary fluid medium comprising, in combination, vessel means defining a generally cylindrical cavity having a substantially vertical longitudinal axes, means defining an inlet passage intersecting said cavity adjacent the upper end thereof and enabling introduction of a high temperature reactor coolant into the upper end of said cavity, an exit passage intersecting said cavity at an elevation below said inlet passage, and a heat exchanger supported by said vessel means within said cavity, said heat exchanger including a primary tube sheet generally adjacent the lower end of said cavity, a plurality of heat transfer tubes supported by said primary tube sheet so as to extend upwardly within said cavity, said heat transfer tubes being adapted to receive a secondary fluid medium upwardly therein, a first shroud disposed circumferentially of said heat transfer tubes and having at least one flow passage formed therein adjacent said primary tube sheet, said first shroud extending upwardly from said primary tube sheet to at least the height of said heat transfer tubes and having a substantially closed wall upper portion and an outwardly flared lower portion, said lower portion having said at least one flow passage formed therethrough, and a secondary shroud substantially coaxial with said first shroud and extending upwardly within said cavity adjacent said inlet passage, said second shroud being isolated within said cavity and cooperative with said first shroud such that primary coolant entering said cavity flows downwardly within said coaxial shrouds and past said heat transfer tubes before exiting through said at least one flow passage.

2. A heat transfer tube as defined in claim 1 wherein said second shroud extends downwardly over said upper portion of said first shroud in substantially coaxial relation therewith, the coaxial portions of said first and second shrouds being spaced from the peripheral surface of said cavity so as to define a flow passage therebetween communicating with said at least one flow passage and said exit passage.

3. A heat exchange arrangement for use in transferring heat from a reactor gas coolant to a secondary fluid medium comprising, in combination:

housing means defining an elongated generally cylindrical cavity having a substantially vertically disposed longitudinal axis and defining upper and lower ends, a first flow passage communicating with said cavity adjacent said upper end and defining a reactor gas coolant inlet into said cavity, a second flow passage communicating with said cavity and defining an exit passage for said reactor coolant, a primary tube sheet supported by said housing means generally adjacent the lower end of said cavity in substantially transverse relation thereto, a secondary tube sheet supported by said primary tube sheet in generally parallel relation therewith, a plurality of spaced bayonet type heat transfer tube assemblies supported by said primary and secondary tube sheets in upstanding substantially parallel relation to the longitudinal axis of said cavity, said tube assemblies having upper ends terminating below said first flow passage, means cooperative with the lower ends of said tube assemblies for passing secondary fluid medium upwardly within said tube assemblies and outwardly from the lower ends thereof, a first shroud having a lower end supported by said primary tube sheet and extending upwardly within said cavity circumferentially of said tube assemblies, said first shroud extending upwardly within said cavity a distance equal to approximately the height of said tube assemblies and having flow passage means formed therein generally adjacent said primary tube sheet, a second shroud supported by said housing means externally of and in substantially coaxial relation to said first shroud, said second shroud terminating at its lower end above said flow passage means in said first shroud and extending upwardly from the upper end of said first shroud, said second shroud defining an open upper end adapted to receive reactor coolant from said first inlet flow passage, and seal means interposed between said first and second shrouds for preventing flow of reactor coolant therebetween, whereby high temperature reactor coolant entering said cavity from said first inlet passage is caused to flow downwardly within said shrouds over said heat transfer tube assemblies and outwardly of said flow passage means in said first shroud to said reactor coolant exit passage so that the temperature of the reactor coolant impinging said primary tube sheet is substantially lower than the temperature of said reactor coolant entering said cavity.

* * * * *